US005520120A

United States Patent [19]

Badger

[11] Patent Number: 5,520,120

[45] Date of Patent: May 28, 1996

[54] PALLET DECK WITH STRAIN RELIEFS

[75] Inventor: David Badger, Henryville, Ind.

[73] Assignee: Packing Materials Corporation, Franklin Park, Ill.

[21] Appl. No.: 427,742

[22] Filed: Apr. 24, 1995

[51] Int. Cl.[6] ..... B65D 19/00

[52] U.S. Cl. ..... 108/51.3; 108/56.3

[58] Field of Search ..... 108/51.3, 56.1, 108/56.3

[56] References Cited

U.S. PATENT DOCUMENTS

| | | | |
|---|---|---|---|
| 2,888,221 | 5/1959 | Connelly | 108/51.3 |
| 4,487,136 | 12/1984 | Beckway | 108/51.3 |
| 4,850,284 | 7/1989 | DeGroot et al. | 108/51.3 |
| 5,289,781 | 3/1994 | Beckway | 108/51.3 |

FOREIGN PATENT DOCUMENTS

| | | | |
|---|---|---|---|
| 0268989 | 5/1968 | Austria | 108/51.3 |
| 2520443 | 11/1975 | Germany | 108/51.3 |
| 2271336 | 4/1994 | United Kingdom | 108/51.3 |

*Primary Examiner*—Peter M. Cuomo
*Assistant Examiner*—Gerald A. Anderson
*Attorney, Agent, or Firm*—Basil E. Demeur; Alan B. Samlan

[57] ABSTRACT

The field of invention relates to a corrugated cardboard pallet of the type generally formed by a pair or more of pallet decks which are stacked atop one another, each of which has finger elements die cut therein radiating outwardly from a central circle and terminating on a circular score line of substantially the same diameter as the inner diameter of one of the leg elements. The die cut lines for the fingers radiate tangentially outwardly to create a substantially spiral pattern. The improvement of the present invention is the provision of stress relief circular punch-out sections positioned adjacent the circular score line and having a diametric dimension extending inwardly from the score line in the direction of the central circle and laterally on each side of each of the die cut lines. The stress relief punch-out sections function to relieve the stress caused when the finger elements are folded downwardly in order to accept the attachment of the pallet legs to the pallet deck.

3 Claims, 4 Drawing Sheets

PALLET DECK WITH STRAIN RELIEFS

BACKGROUND OF THE INVENTION

The present invention relates to corrugated pallets, and in particular to the type of corrugated pallets which have been developed for the purpose of providing inexpensive and yet light weight pallets constructed of corrugated cardboard.

As is presently known, pallets are widely used in all industries for the purpose of stacking and transporting various goods. In the past, pallets were formed of wood, in order to lend rigidity and strength to the pallet and so that merchandise of great weight could be stacked and transported thereon. However, with the advent of conservation, and preservation of the natural resources, the use of wood for constructing pallets has been deemed to be undesirable. Even more importantly, it has been determined by many countries in the world that wood is a nesting place for various types of bacteria and other undesirable germs, especially when the wood has become wet or is rotting. Many countries, therefore, have enacted rules and regulations for the importation of products which are stacked on wood pallets. Indeed, many countries require that wood pallets cannot be introduced into the country that have not been properly fumigated. This in turn causes several problems for the reason that in order to fumigate the pallets, it is necessary to fumigate even the product stacked on the pallets, which therefore introduces undesirable chemicals into the products that are being stacked and transported. For this reason, alternate types of materials have been utilized in connection with the construction of pallets.

In this connection, the art has gravitated toward corrugated pallets which are made of corrugated paper and other materials which are relatively inexpensive, but yet capable of bearing weight, and are totally recyclable. Applicant herein is the owner of U.S. Pat. No. 4,487,136, which is directed to a pallet construction and claims a corrugated pallet having leg elements which are installed onto the pallet deck which yields a construction for a corrugated pallet having sufficient strength for virtually all applications in connection with the stacking and the transporting of goods placed thereon. Applicant has further improved on this type of construction in U.S. Pat. No. 4,850,284 which relates to a cross-laminated pallet deck in order to further enhance the rigidity and strength of the subject pallet.

Applicant has made a further improvement as demonstrated in U.S. Pat. No. 5,289,781, which basically relates to the method of forming the finger elements which participate in the manner and method by which the pallet legs are secured to the pallet deck.

As Applicant has demonstrated in its prior patents, the method of attaching the pallet legs to the pallet is by die cutting a plurality of finger elements in a tangentially radiating manner in order to create a substantially spiral pattern with the fingers. The core legs are installed into the pallet deck by twisting an inner leg in the direction of the spiral pattern of the finger elements, and nesting the inner leg within an outer leg having the fingers interposed in the annulus formed there between. Attachment is achieved by means of the use of an adhesive which is applied to the finger elements such that once the finger elements are nested within the annulus formed between the inner and outer leg elements, the cores forming the leg elements will become adhesively secured to the pallet deck via the finger elements.

U.S. Pat. No. 5,289,781 represents an improvement on that process in that each of the finger elements is further provided with a series of perforations linearally aligned down the center of each finger element such that once an adhesive is applied to the finger elements, the adhesive is permitted to permeate through the finger elements and more securely attach the inner and outer core leg members to the finger elements and hence to the pallet deck.

It has now been observed that the manner in which the core legs are installed onto the pallet, requiring a twisting action of the inner leg in the direction of the spiral pattern of the finger elements, in order to nest the inner leg within an outer leg with the finger elements interposed in the annulus formed therebetween, that such twisting action will, on occasion, cause a fracturing of the material forming the finger elements. The fracturing is caused, on occasion, as the inner leg is twistingly engaged in order to grasp the finger elements between the inner and outer core leg members. It has been determined that in the event that any fracturing of the material occurs, this may have the tendancy to reduce the relative strength of the pallet leg relative to the pallet deck.

The present invention seeks, therefore, to eliminate the problem of a material fracturing, as will be more fully described hereinafter.

OBJECTS AND ADVANTAGES

It is therefore the principal object of the present invention to provide an improved corrugated pallet by incorporating a stress relief means associated with the finger elements such that when the core legs are mounted to the pallet deck via the finger elements, material fracturing is eliminated.

In connection with the foregoing object, it is a further object of the present invention to provide an improved corrugated pallet of the type described wherein each of the finger elements which are die cut in a spiral configuration and are further provided with stress relief means immediately adjacent to the circular score line from which each of the finger elements radiate, each of the strain relief means being positioned inwardly of the score line in the direction of the circular aperture forming the base of the finger elements, and extending laterally on each side of each die-cut line forming the finger elements.

In connection with the foregoing objects, it is a further object of the present invention to provide a strain relief means for the finger elements which consist of the circular punch-out section which is positioned adjacent to the score line, and having a diametric dimension extending inwardly in the direction of the central circle, and extending laterally to each side of the die-cut line forming the finger element such that upon the bending of each of the finger elements, and upon the twisting motion in order to engage the inner leg and the outer leg on either side of the finger elements, the fracturing of the material forming the finger elements is eliminated.

Further features of the invention pertain to the particular arrangement of the parts and the method of operation, all of which is more fully disclosed in the specification set forth hereinafter, and specifically set forth in the claims.

SUMMARY OF THE INVENTION

In summary, the present invention provides an improved corrugated pallet wherein the pallet legs are more securely affixed to the pallet deck. The improvement resides in the recognition that the provision of strain relief means associated with each finger element will eliminate the possibility of material fracturing incident to the method of installing the core legs onto the pallet deck utilizing the spiral patterned finger elements in the manner more fully set forth hereinafter. The strain relief means consists of providing a circular punch-out section immediately adjacent to but extending inwardly for a short distance from the circular score line which forms the outer perimeter of the finger elements incident to the manufacture of the corrugated pallet. Each of the circular punch-out sections are adjacent to the circular score line, and has a diametric dimension extending inwardly in the direction of the central circle, and extends laterally on each side of the die-cut line which forms each of the finger elements. The circular punch-out sections forming the strain reliefs for each of the finger elements serves the additional purpose of providing additional flow paths for the adhesive once the finger elements have been treated with the adhesive for the securement of the inner and outer core legs for attachment to the pallet deck.

DETAILED DESCRIPTION OF DRAWINGS

Figure 1:
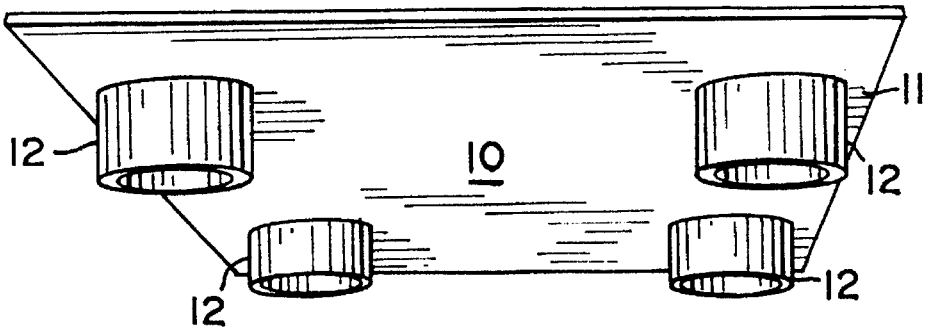
FIG. 1 is a perspective view showing a typical single pallet deck corrugated pallet having a series of four legs affixed thereto.

With reference to FIG. 1 of the drawings, there is shown a typical corrugated pallet 10 of the type generally represented in U.S. Pat. No. 4,487,136. This type of construction generally is formed from a pallet by a pallet deck 11 to which a series of four legs 12 are secured. The method of securement of the pallet legs 12 to the pallet deck 11 is generally disclosed in U.S. Pat. No. 4,487,136. As indicated therein, the pallet deck 11 is die cut in each position where a pallet leg 12 is intended to be secured, by die cutting an opening consisting of a series of finger elements of a generally triangular configuration, having as their base a circular score line 14 (See FIG. 3), which defines a hinge point for each finger element. The finger elements 20 extend to an interior circle 16 as is understood, again, from the description set forth in U.S. Pat. No. 4,487,136. For purposes of the present invention, each finger element shall be referred to by the numeral 20.

Figure 5:
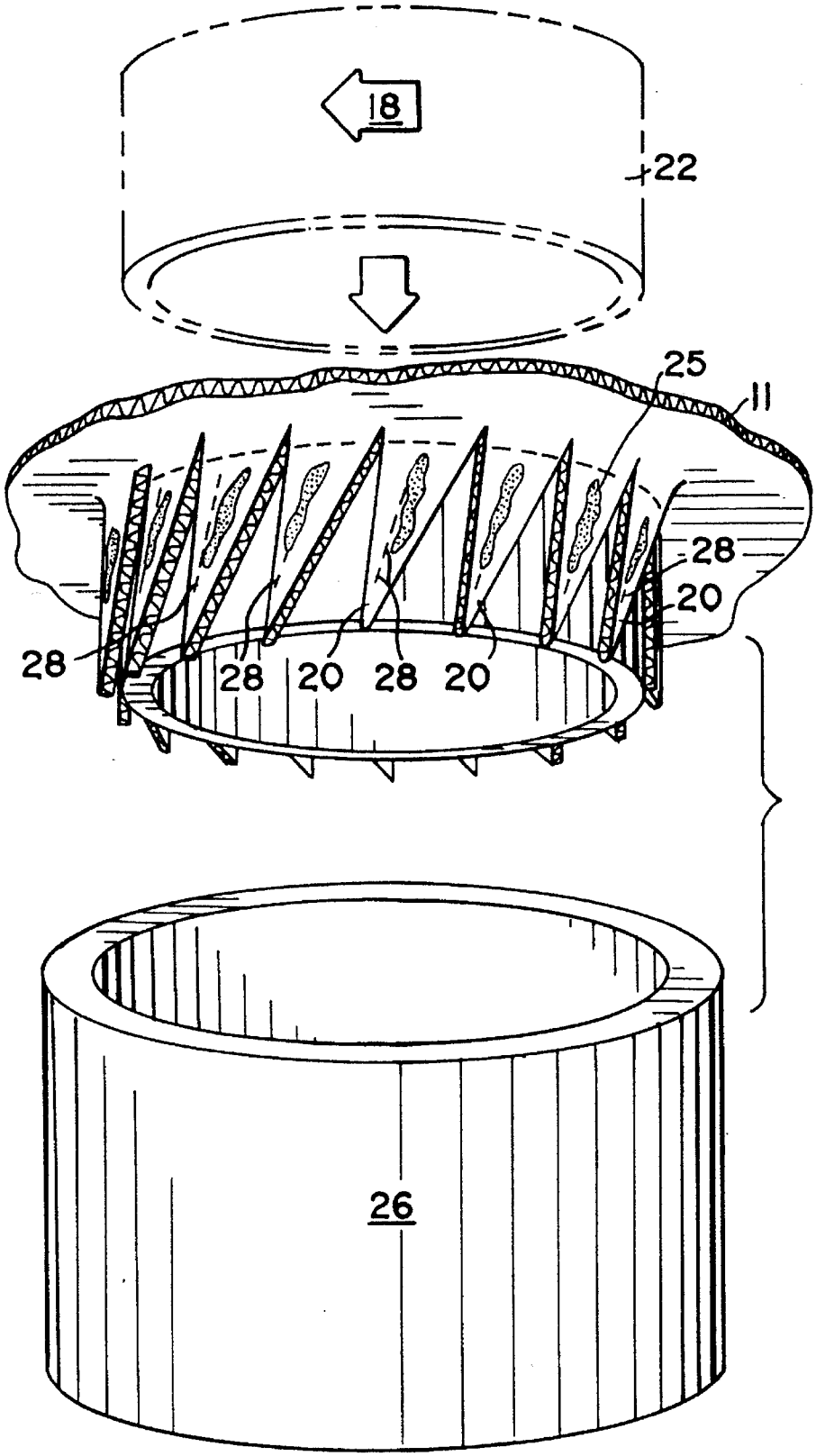
FIG. 5 is a front elevational exploded view, showing the manner in which the inner and outer core leg elements are positioned within the pallet deck and further illustrate perforations within the finger elements as a means for enhancing adhesive dispersion.

In connection with the assembly of the pallet 10 as shown in FIG. 1, the pallet deck 11 is introduced into a die cutting machine, which will die cut the finger elements 20 in the positions required in order to insert the legs 12, whether there be four or more legs. Once the finger elements 20 are die cut, an inner leg member 22 (See FIG. 5) is inserted downwardly through the circular score line 14 thereby pushing the finger elements 20 downwardly, and twisted in the direction of the arrow as depicted in FIG. 5 of the drawings by the numeral 18. It will be appreciated that adhesive is first applied to the inner surface 21 of the fingers 20 (FIG. 3) prior to the insertion of the inner leg member 22 therein, such that once the inner leg member 22 is pressed downwardly therethrough, the adhesive will spread over the surface skin of the finger element 20 and come into touching contact with the inner leg member 22.

As indicated in both U.S. Pat. No. 4,487,136 and U.S. Pat. No. 4,850,284, the adhesive 25 (FIG. 5) is also applied to the outer surface of the finger element 20, such that when the outer leg member 26 is positioned on the outer surface of each finger element 20, the adhesive will expand and cover the outer surfaces of finger elements 20 relative to the interior side wall of the outer leg member 26.

As described and shown, the corrugated pallet 10 will therefore consist of a pallet deck 11 which has a plurality, such as four or more, leg members secured thereto, by means of a plurality of die-cut finger elements 20 which are die cut in a substantially tangential manner in order to create a substantially spiral pattern.

Figure 6:
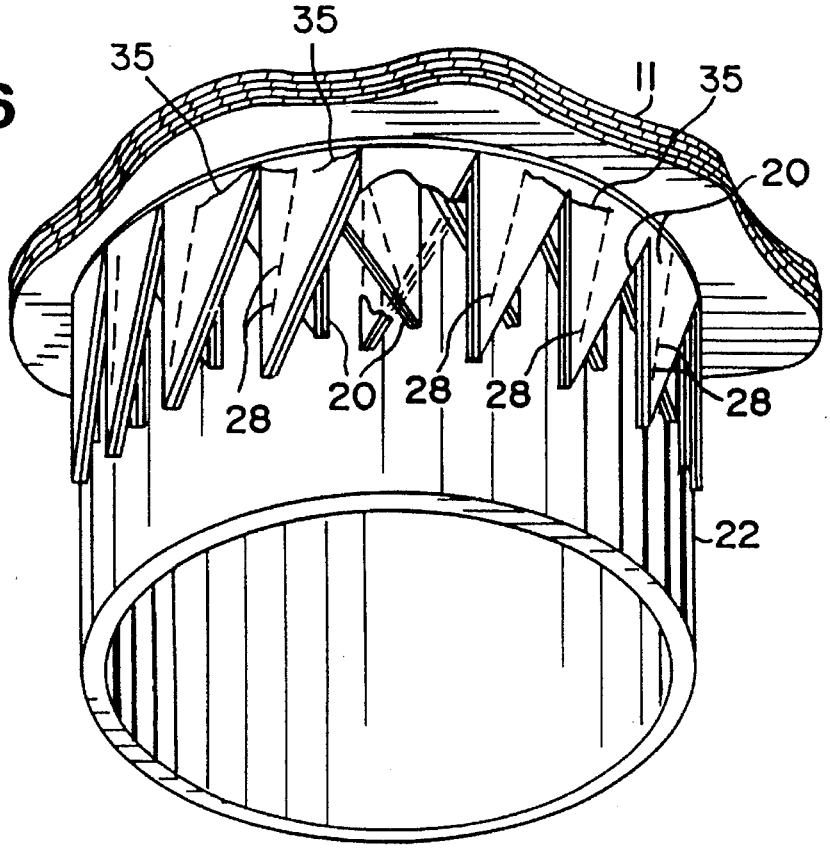
FIG. 6 is a perspective, front elevational view, partly broken away, showing the manner in which the double pallet deck is die-cut including perforations die-cut into the finger elements to enhance the spread of adhesive incident to the manufacturing process and showing finger elements with fracture lines as per the prior art.

As has been indicated previously, the spiral pattern is important to the integrity of the pallet for the reason that when the inner leg member 22 is inserted and pressed downwardly to nest within the outer leg member 26 with the finger elements 20 interposed therebetween, it is rotated in the manner indicated in FIG. 5, and this rotational movement will fix the finger elements 20 in a nesting position in the annulus created between the inner and outer leg elements as depicted in FIG. 6 of the drawings. As has been indicated in the past, when the finger elements 20 are cut in a sunburst pattern as is known in the prior art, and not in a spiral pattern as indicated herein, the downward insertion of the inner leg member relative to the outer leg member has a tendency to cause a fracturing of the finger elements thereby weakening the pallet structure.

It has now been determined that even with a spiral cut pattern as indicated herein, if there are any imperfections in the die-cutting machinery which die cuts the finger elements 20 prior to the insertion of the inner leg member 22, one can still obtain fracturing of the finger elements causing fracture lines to occur as generally depicted by the numeral 35 (See FIG. 6). It is believed that the fracture lines 35 may well be caused because of the die-cutting machinery does not completely die-cut the finger elements 20 when placed into the die cutting machine, and hence, upon the insertion of the inner leg 22 to push the finger elements 20 downwardly, the subsequent twisting rotational movement will in fact cause some fracture lines 35 to be formed. In such an eventuality, those finger elements 20 having fracture lines 35 will not be securely held an interposed between the inner leg 22 and outer leg 26, thereby causing some slight weakening of the pallet 10 as a complete assembly. As will be described hereinafter, the present invention seeks to eliminate the fracturing problem.

Figure 2:
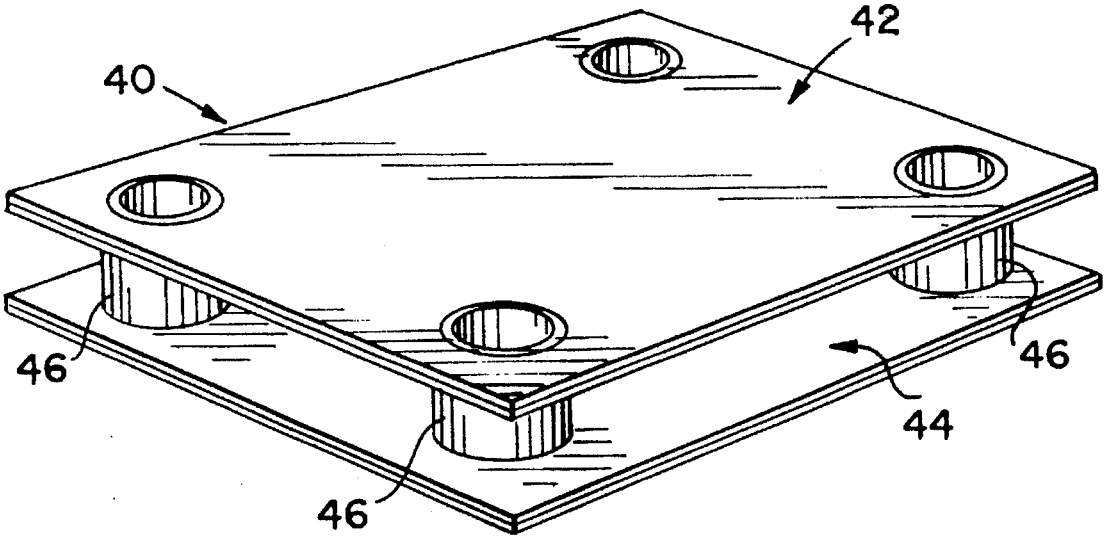
FIG. 2 is a perspective view showing a typical double deck corrugated pallet having a series of four legs securing the pallet decks as a completed assembly.

FIG. 2 is merely intended to illustrate still another version of a corrugated pallet which is intended to be within the scope of the present invention. The pallet illustrated in FIG. 2 is generally represented by the numeral 40, and is generally referred to as a double deck pallet. The double deck pallet includes an upper deck 42 and a lower deck 44 which are maintained in spaced apart secured position by means of plurality of leg members 46. It is contemplated by the present invention that regardless of whether one constructs a pallet in accordance with FIG. 1 consisting of a single deck pallet, or a pallet constructed in accordance with FIG. 2 consisting of a double deck pallet, the method of the present invention, and the resulting product, applies.

Figure 4:
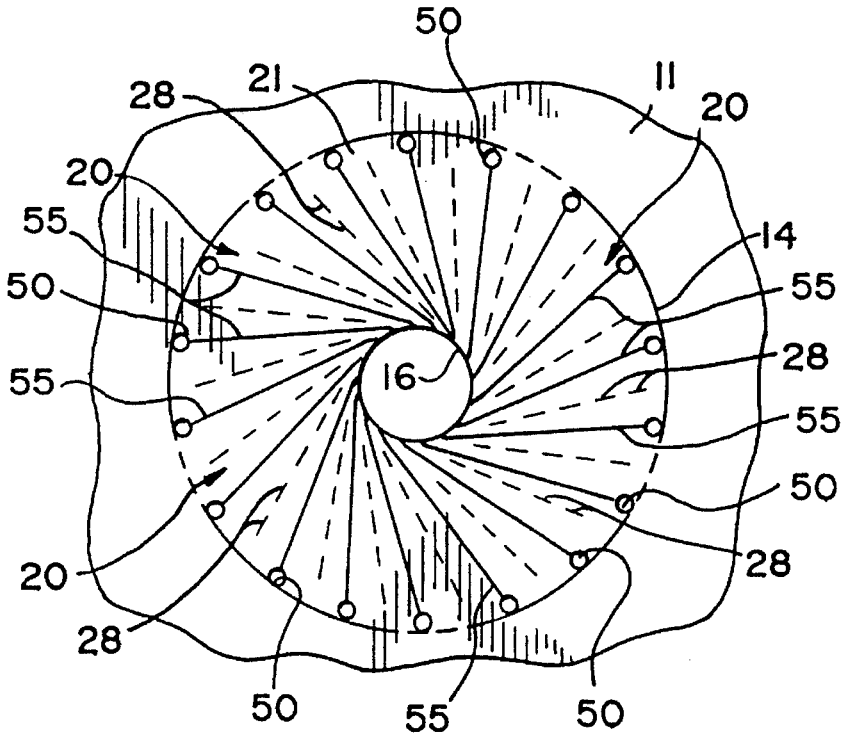
FIG. 4 is a top perspective view showing the finger elements cut into the pallet deck and the perforations die cut into the surface thereof, and the improvement consisting of the strain relief circular punch-out section cut through each of the die-cut lines forming the finger elements.
Figure 7:
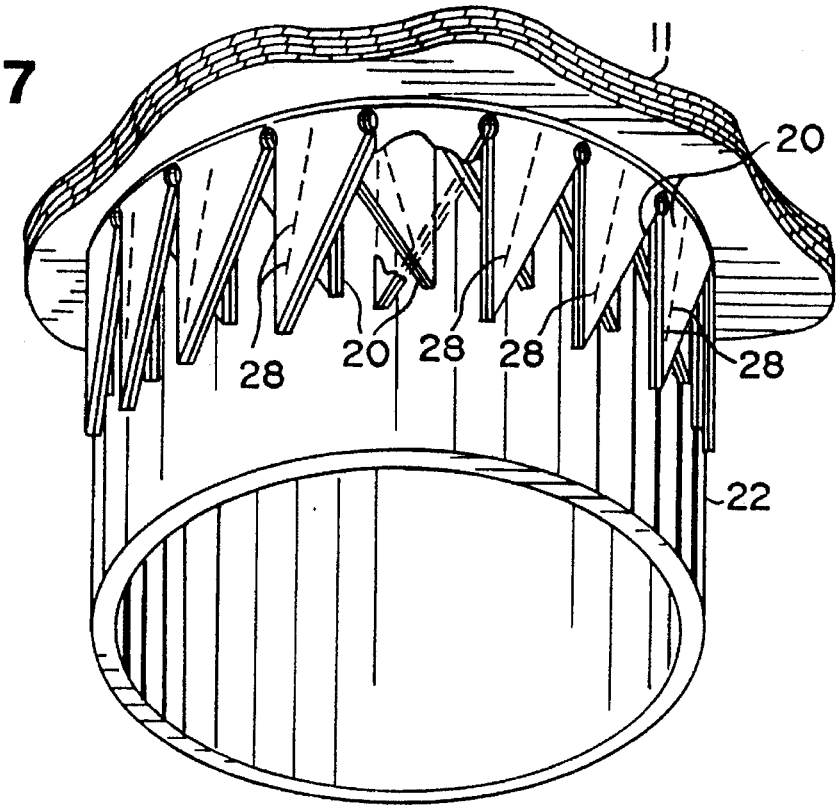
FIG. 7 is a perspective front elevational view, partly broken away, showing the improvement of the present invention consisting of the stress relief circular punch-out section thereby to permit the easy folding of the finger members into position and eliminating a material fracturing.

As more specifically shown in FIGS. 4 and 7 of the drawings, the present invention contemplates the provision of a plurality of circular stress relief circular punch-out sections 50 which are die cut into the finger elements 20 at the same time that the finger elements are formed by the die-cutting machine. It will be observed that the preferred embodiment of the present invention, a stress-relief circular punch-out section 50 is positioned between each of the finger elements such that each finger element 20 has a stress relief circular punch-out section 50 adjacent each of the score lines forming that finger element 20. It will further be observed that each circular punch-out section 50 is positioned adjacent circular score line 14 and extends inwardly for a short diametric distance toward the interior circle 16. Further, each strain relief circular punch-out section 50 extends laterally to either side of the finger element score line 55 in order to insure that upon the downwardly bending and rotational twisting of the finger elements 20 incident to the insertion of the inner leg 22, that the stress of the twisting motion is taken up by the strain relief circular punch-out section 50 eliminating the possibility of material fracturing.

Figure 3:
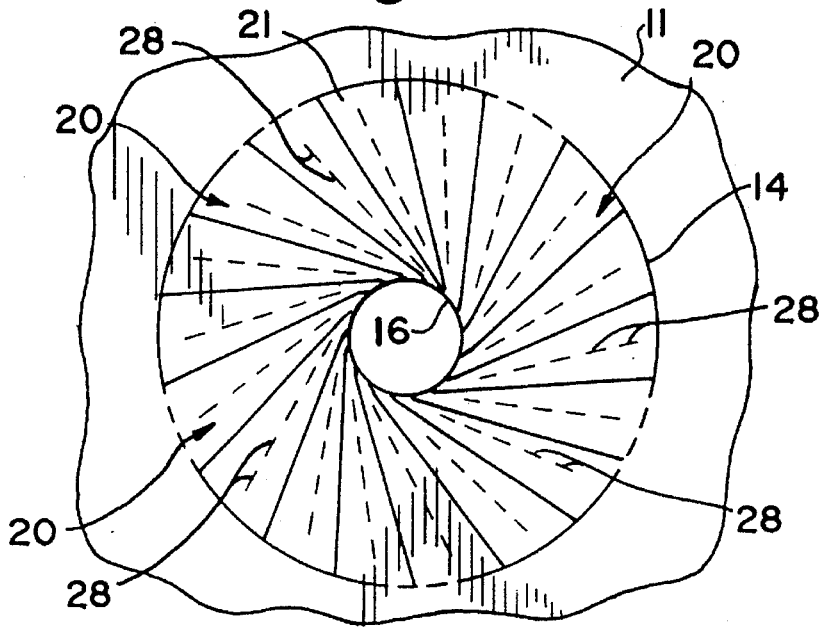
FIG. 3 is a top perspective view showing the die-cut finger elements and the perforations die cut into the surface of the pallet deck in order to form the finger members for attachment of the pallet legs in accordance with the prior art.

It will further be noted specifically with respect to FIGS. 3 and 4 of the drawings, that the improvement as described and claimed in U.S. Pat. No. 5,289,781 consisting of a series of perforations 28 applied through each of the finger elements 20 is maintained in connection with the present invention. As was indicated therein, the perforations 28 function to permit the adhesive which is applied to each of the finger elements 20 to permeate and enter into the interior confines of the corrugated materially such that upon setting, both the inner leg member 22 as well as the outer leg member 26 will have a greater adhesive base for securement to the fingers 20, and hence, the pallet 10 as a whole. This feature of the invention as described in U.S. Pat. No. 5,289,781 as aforenoted is maintained in connection with the present invention. However, it will also be appreciated that due to the method of construction, when the adhesive is applied to each of the finger elements 20, and upon the downward bending and rotational twisting movement of the inner core leg 22, the strain-relief circular punch-out sections 50 will also aid in the permeation of the adhesive as between the inner core leg 22 and outer core leg 26 with the finger elements 20 interposed in the annulus therebetween. Hence, in addition to functioning as a strain relief for each of the finger elements 20, the circular punch-out sections 50 will also further aid in the distribution and permeation of the adhesive incident to the assembly process for assembling the pallet legs to the pallet deck.

It has been found that by applying the strain-relief circular punch-out sections 50, the testing that has been performed to date indicates that material stress and tearing which could be caused due to the possible improper or imperfect die cutting of the finger elements is virtually eliminated since each of the finger elements 20 now have a circular relief area to take up the stress of material bending and twisting.

FIG. 7 illustrates the manner in which the finger elements are interposed relative to the inner core leg member 22, and it will be apparent that the outer core leg 26 as shown in 26 may then easily be applied over the finger elements 20 in order to complete the assembly.

Hence, in all respects, the present invention adds a further improvement to the construction of a corrugated pallet having core legs installed thereon for the purpose of providing a light weight and inexpensive pallet assembly for the transportation and movement of products thereof.

While there has been described what is at present considered to be the preferred embodiments of the invention, it will be understood that further modifications may be made therein, and it is intended to cover in the appended claims all such modifications as fall within the true spirit and scope of the invention.

I claim:

1. In a pallet of the type formed by a pallet deck having a plurality of tubular legs attached thereto, wherein each of the tubular legs is formed from an inner leg and an outer leg element, and wherein the pallet deck is formed of at least two pallet deck members of corrugated cardboard stacked together atop one another and each of the pallet deck members at each leg attachment point having a plurality of finger elements formed of die-cut lines radiating outwardly from a central circle and terminating on a circular score line of substantially the same diameter as the inner diameter of an outer leg element, the finger elements being die cut in the respective ones of the pallet deck members, the inner and outer leg members being proportioned to nest within one another and to retain the finger elements die cut in both pallet deck members within the annulus formed between the nested inner and outer leg elements, and wherein the tubular legs are secured to the pallet deck and the pallet deck members are secured together one atop the other by placing an outer leg element under the stack pallet deck members and aligned with the circular score line, the inner leg element atop the stack deck members and aligned with the circular score line, applying an adhesive on the finger elements and pressing the inner leg element through the pallet deck members into the outer leg element with the finger elements being captured in overlapping relationship between the outer and inner leg elements, and spreading the adhesive therebetween, the improvement comprising, each of said die-cut line forming said finger elements provided with stress relief means positioned adjacent the circular score line and functioning to relieve the stress on each finger element as it is folded and nested within the annulus formed between the nested inner and outer leg element incident to the mounting of the pallet legs onto the pallet deck.

2. The improved pallet as set forth in claim 1 above, wherein said stress relief means comprises a circular aperture formed by a punch-out section, the circular punch-out section being positioned adjacent the circular score line and extending laterally to each side of said die-cut line, whereby each of said circular punch-out sections relieves the material stress of each finger element as it is folded down and nested between the inner and outer leg elements incident to the mounting procedure for mounting the pallet legs to the pallet deck, and eliminating the possibility of the fracturing of the finger members.

3. The improved pallet as set forth in claim 2 above, wherein each of said circular punch-out sections are formed tangential to said circular score line and each has a diametric dimension extending inwardly from said circular score line in the direction of central circle, and extending laterally of each of said die cut lines, whereby each of said circular punch-out sections is positioned tangential to and entirely below and inwardly of said circular score line thereby to function as a stress relief aperture for each of the finger members and eliminate the possibility of material stress fracturing the finger elements.

* * * * *